US007698769B2

(12) United States Patent
Walters

(10) Patent No.: US 7,698,769 B2
(45) Date of Patent: Apr. 20, 2010

(54) DEVICE TO CATCH AND RETRIEVE FOAM PELLETS

(75) Inventor: William O Walters, Seattle, WA (US)

(73) Assignee: The Boeing Company, Chicago, IL (US)

( * ) Notice: Subject to any disclaimer, the term of this patent is extended or adjusted under 35 U.S.C. 154(b) by 1054 days.

(21) Appl. No.: 11/375,673

(22) Filed: Mar. 14, 2006

(65) Prior Publication Data

US 2006/0179588 A1 Aug. 17, 2006

Related U.S. Application Data

(63) Continuation-in-part of application No. 11/214,180, filed on Aug. 30, 2005, now Pat. No. 7,666,263, which is a continuation of application No. PCT/US2004/004793, filed on Feb. 18, 2004, which is a continuation of application No. 10/779,500, filed on Feb. 14, 2004, now abandoned.

(60) Provisional application No. 60/448,134, filed on Feb. 20, 2003, provisional application No. 60/448,135, filed on Feb. 20, 2003, provisional application No. 60/448,136, filed on Feb. 20, 2003.

(51) Int. Cl.
*B08B 9/00* (2006.01)

(52) U.S. Cl. ..... 15/3.51

(58) Field of Classification Search ..... 15/3.5, 15/3.51

See application file for complete search history.

(56) References Cited

U.S. PATENT DOCUMENTS 4,974,662 A * 12/1990 Bizard ..... 165/95
5,926,892 A * 7/1999 Fukuhara et al. ..... 15/3.5

* cited by examiner

*Primary Examiner*—Randall Chin
(74) *Attorney, Agent, or Firm*—Harness, Dickey & Pierce, P.L.C.

(57) ABSTRACT

An apparatus for the rapid loading, launching and retrieval of foam pellets for tube cleaning. The apparatus uses a block configuration to allow gravity feed and rapid firing of pellets into tubes. The apparatus includes a hopper feeder attachment, which is self-adjusting during pellet jams.

9 Claims, 5 Drawing Sheets

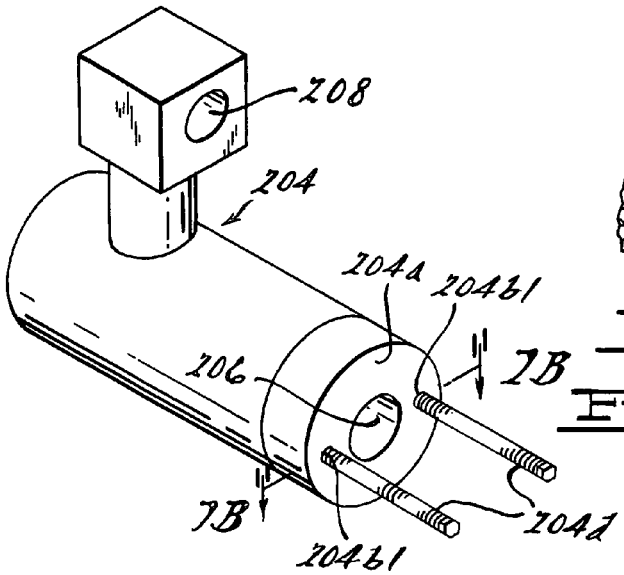
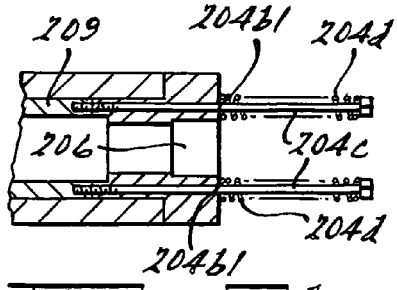
Fig. 7b.
Fig. 7a.
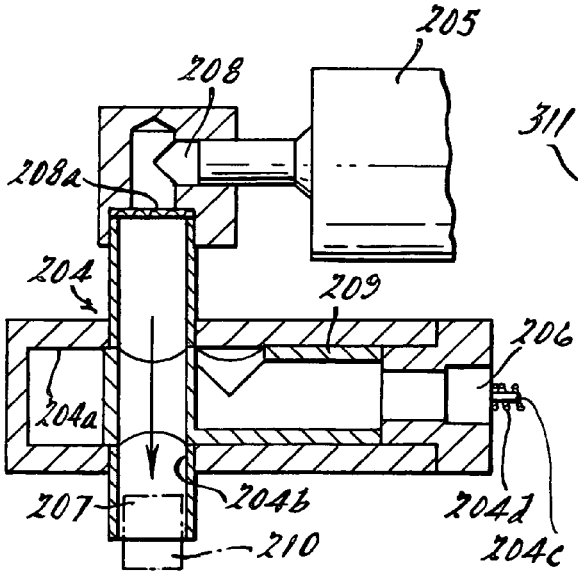
Fig. 8.
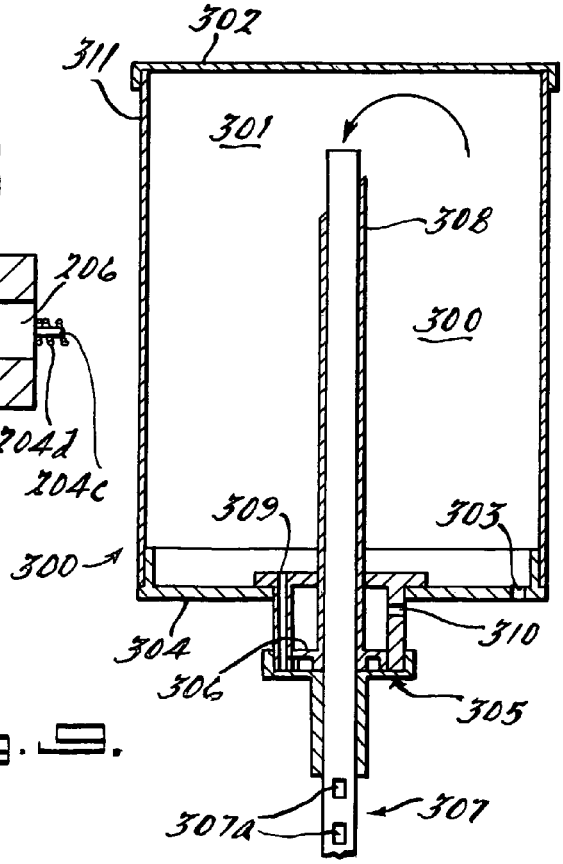
Fig. 9.

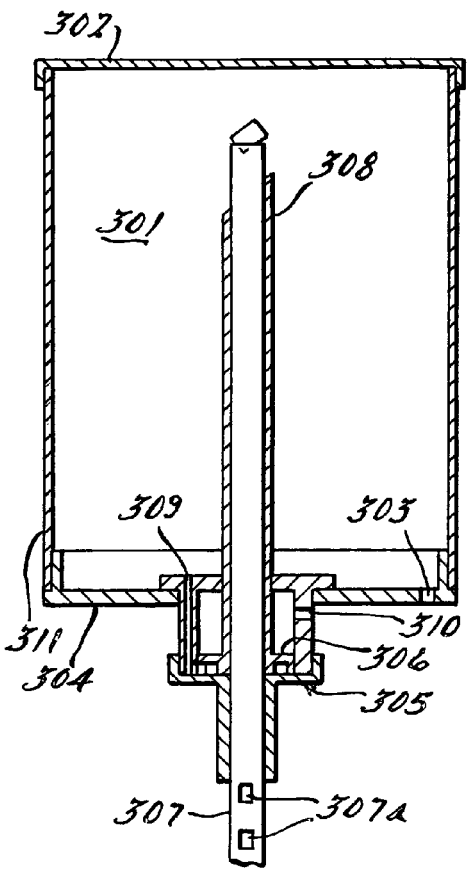
Fig. 10.
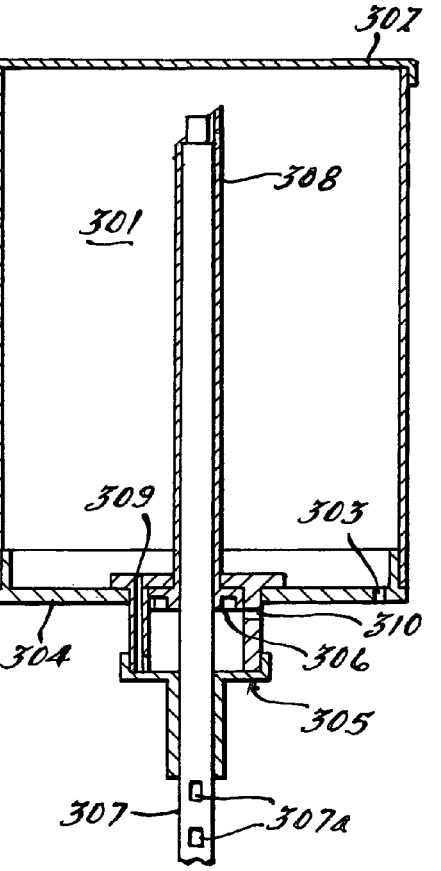
Fig. 11.
Fig. 10b.
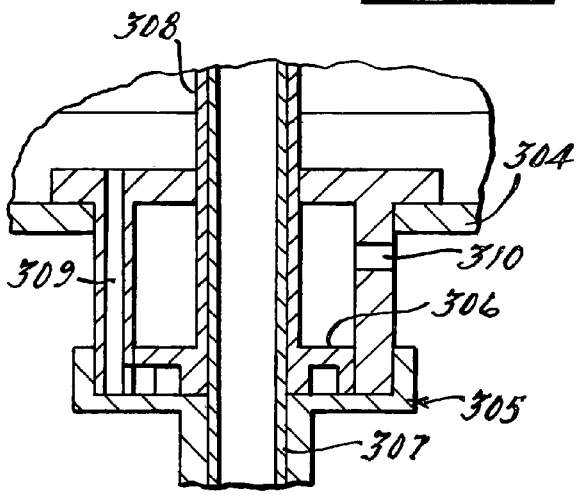
Fig. 10a.
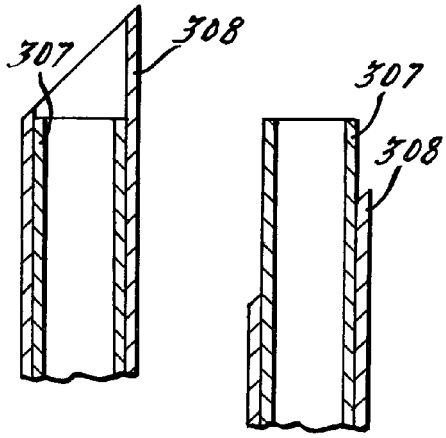
Fig. 10c.

DEVICE TO CATCH AND RETRIEVE FOAM PELLETS

CROSS-REFERENCE TO RELATED APPLICATIONS

This application is a continuation-in-part of U.S. application Ser. No. 11/214,180, filed on Aug. 30, 2005, now pending, which claims priority from PCT application Ser. No. PCT/US2004/004,793, filed Feb. 18, 2004, which in turn claims priority from U.S. provisional application Ser. Nos. 60/448,134, 60/448,135, and 60/448,136 filed on Feb. 20, 2003 and is a continuation of U.S. application Ser. No. 10/779,500, filed on Feb. 14, 2004, now abandoned. The disclosures of all of the above-identified applications are hereby incorporated by reference into the present application.

FIELD

The present invention relates to an apparatus for the cleaning of tubes. More particularly, to an attachment used in the cleaning of tubes using pellets and the retrieval and reuse thereof.

BACKGROUND

Industry has been looking for ways to clean hydraulic tubing that can replace the current method of vapor degreasing. A vapor degreaser is a large organic solvent still on which the solvent vapor condenses and drains off the parts to be cleaned. Vapor degreaser systems are large, fixed installations that have a high purchase price and maintenance costs. Companies that use this method also must obtain a yearly operating permit for their facilities from the Clean Air Agencies because of the potential for air pollution and health risks that this cleaning method poses. Replacing these vapor degreasers with small, low-cost cleaning methods allows installations to consolidate sites and save money.

One method to replace vapor degreasing is to propel a polyurethane foam pellet through the tube using compressed air. The tight fitting foam pellet scrubs the interior wall of the tube as it passes through. This is a widely used technique and there are at least three makers of pellets and pellet launching equipment worldwide. One component lacking from present day pellet cleaning systems is suitable equipment to efficiently capture and return the spent pellet to the operator so that it may be examined.

The pellet system is currently used to clean tubes at a relatively high rate in close quartered work cells. Tubes are bent into a large variety of complicated shapes and lengths. Pellets must be loaded, launched/retrieved and examined with a minimum of operator movement. Equipment that requires the operator to find and retrieve the spent pellet lowers productivity. Safety and noise consideration require that the pellets be fired into a containment device and that the noise be reduced to acceptable levels.

SUMMARY

The present system and method provides an innovative, unique and useful alternative to commercially available foam pellet launchers for tube cleaning. In one form, the present system provides a quick and efficient automatic loader and launcher for foam pellets. The system comprises foam pellets that are gravity fed through a tubular magazine into a cylindrical vertical passageway in a block. This passageway is intersected at a right angle by a cylindrical horizontal passageway about the middle of the block. Below this horizontal passageway the vertical bore has a valved port. The valve releases compressed air into the passageway on a piloted air command. Free to slide in the horizontal passageway, a cylindrical shuttle is attached at one end to a pneumatic actuator. At its opposite end is a hole slightly larger than and aligning with the vertical bore when the shuttle is extended. Also at this end, the shuttle has a pin through it that extends through slots on opposite sides of the block. The pin can contact a spring loaded release lever and rotate it about an axle through the block. The release lever straddles the block and has a projection that protrudes through a small hole intersecting the vertical passageway in the block.

One aspect of the present system regards a foam pellet catcher and retriever having a transfer tube that receives the foam pellet from a cleaned tube. The transfer tube transfers the foam pellet to a chamber under air-pressure. The foam pellet remains in the chamber until the air-pressure is removed, at which time the foam pellet then exits the chamber.

Another aspect of the system and method is a hopper attachment used to rapidly load pellet launchers. Additionally the attachment self-corrects jammed pellets, thus providing a savings from loss of down time and cost of recovery.

Another aspect of the system and method comprises a fitting with a flexible seal opening to receive the (exit) end of the tube being cleaned, and a return tube to carry the pellet back to the operator where a receiver captures the pellet, separates it from the air stream and releases it to the operator.

Each aspect of the present system and method provides an innovative, unique and useful attachment to commercially available foam pellet launchers for tube cleaning. This attachment speeds up the process for pellet retrieval and provides productivity improvements because the pellet method allows the user to go from the current batch-processing method to one-piece processing in work cells.

Further areas of applicability of the present invention will become apparent from the detailed description provided hereinafter. It should be understood that the detailed description and specific examples, while indicating various preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 7*a* is a perspective/rear view of one embodiment of the foam pellet catcher and receiver;

FIG. 7*b* is a side cross-sectional view taken in accordance with section line 7*b*-7*b* in FIG. 7*a* illustrating one of the rods associated with one of the return springs being connected to the slide valve;

FIG. 8 shows a cross-sectional view of an embodiment of the retrieval chamber of FIG. 6;

FIG. 9 shows another embodiment of a hopper/feeder;

FIG. 10 shows a hopper/feeder with pellet jammed in the top of a feed tube;

FIG. 10*a* is an enlarged cross-sectional side view of the piston device of FIG. 10;

FIG. 10*b* is an enlarged side, cross-sectional view of the upper ends of the outer and inner tubes of FIG. 10;

FIG. 10*c* is a view of the outer and inner tubes of FIG. 10*b*, but with the outer tube in the position it assumes when there is no pellet jammed in the inner tube; and FIG. 11 shows hopper/feeder with the pellet righted.

DETAILED DESCRIPTION

The following description of various embodiment(s) is merely exemplary in nature and is in no way intended to limit the invention, its application, or uses.

Reference will now be made in detail to one embodiment of the invention, an example of which is illustrated in the accompanying drawings. While the invention will be described in connection with a particular embodiment, it will be understood that it is not intended to limit the invention to that embodiment. On the contrary, it is intended to cover all alternatives, modifications, and equivalents as may be included within the spirit and scope of the invention defined in the appended claims.

Figure 1:
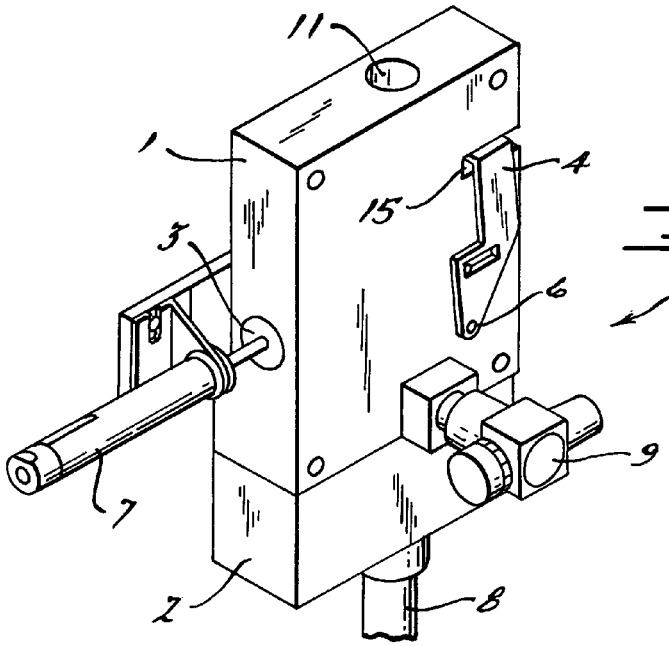
FIG. 1 shows an embodiment of the invention.
Figure 2:
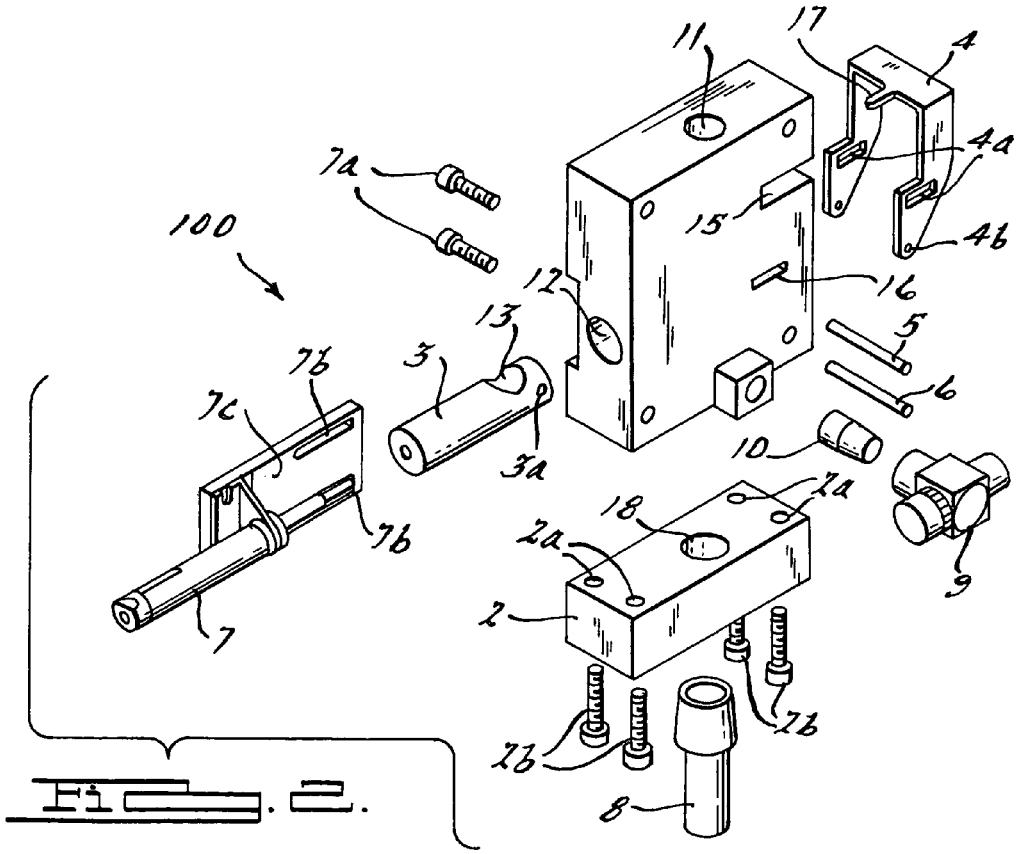
FIG. 2 shows an exploded view of some of the major components of the invention.

Referring to FIGS. 1 and 2, a device 100 for automatically loading and firing foam pellets comprises a block 1 that contains a cylindrical vertical passageway 11. Foam pellets are gravity fed through a tubular magazine (shown as item 307 in FIGS. 10 and 11) into the cylindrical vertical passageway 11 of the block 1. This passageway 11 is intersected at a right angle by a cylindrical horizontal passageway 12, about the middle of the block 1. Below this horizontal passageway 12 the vertical passageway 11 has a valved port 10. A valve 9 releases compressed air into the vertical passageway 11 on a piloted air command. Free to slide in the horizontal passageway 12, a cylindrical shuttle 3 is attached at one end to a pneumatic actuator 7. At its opposite end is a hole 13 slightly larger than and aligning with the vertical passageway 11. The pneumatic actuator 7 is secured to the block 1 by a pair of threaded fasteners 7*a* that extend through corresponding slots 7*b* in a mounting plate 7*c*, and into blind threaded holes (not shown) in the block 1. The shuttle 3 has a pin 5 through it that extends through a bore 3*a* therein, through slots 16 on opposite sides of the block 1, and through slots 4*a* in a spring loaded release lever 4. This pin 5 contacts the spring loaded release lever 4 and rotates it about an axle 6 that extends through the block 1. The release lever 4 straddles the block 1 and has a projection 17 that protrudes through a small hole 15 intersecting the vertical passageway 11 of the block 1.

Figure 3:
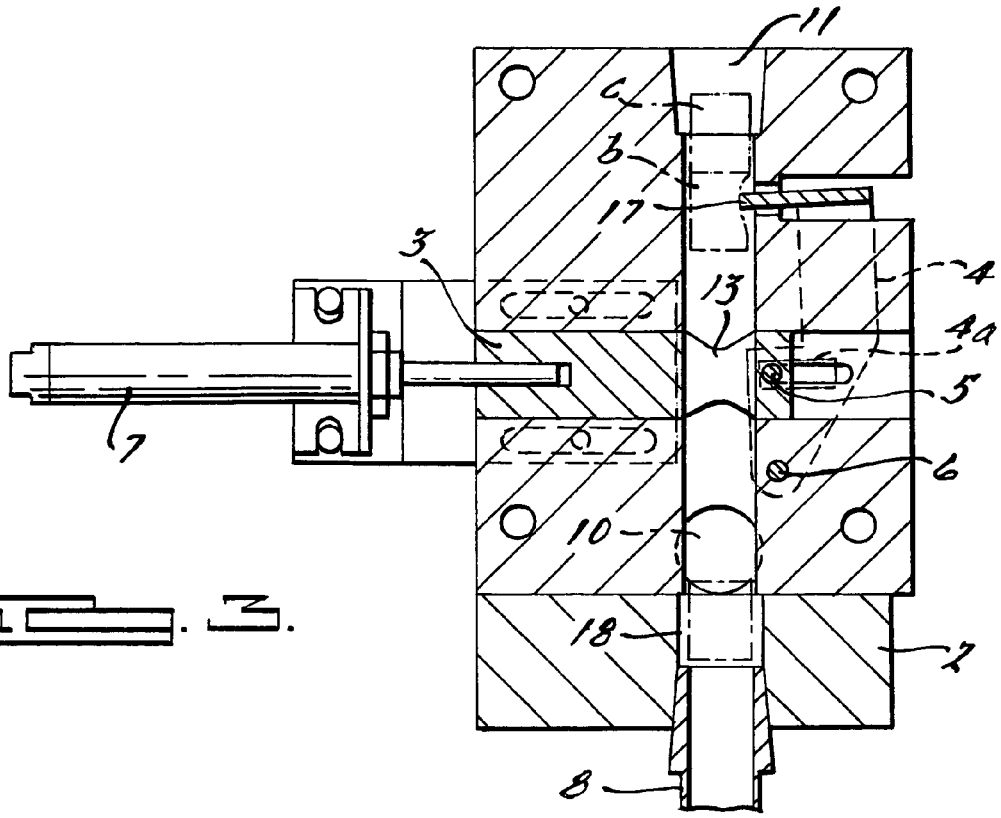
FIG. 3 shows a detailed cross-sectional view of the invention with its release lever in the locked position.
Figure 4:
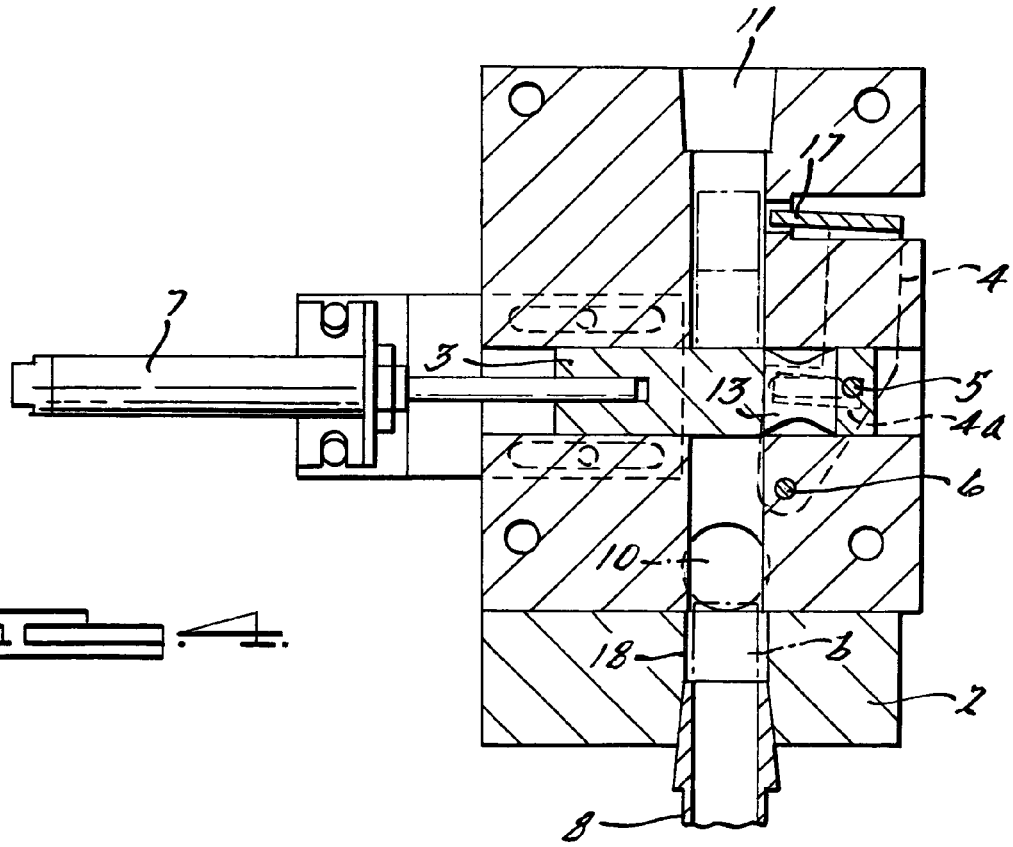
FIG. 4 shows a detailed cross-sectional view of the invention with its release lever in the unlocked position.

Referring to FIG. 3, operation starts with one pellet (a) in the chamber below the piloted valve 10. The shuttle 3 is in the retracted position and the hole 13 is aligned with the vertical passageway 11. The pin 5 on the shuttle 3 does not contact the lever 4 allowing the projection on the lever 4 to jam the lowest pellet (b), and pellet (c), above the shuttle 3 in the vertical passageway 11. No pellets can fall through the hole 13 in the shuttle 3 to the bottom. Referring to FIG. 4, on triggering, the shuttle 3 is pushed into the forward position by the actuator 7, first blocking the vertical passageway 11. Then as it moves farther, the pin 5 pushes the release lever 4 back releasing the pellets. The pellets drop together until the lowest one (b) rests on top of the shuttle 3. Once the shuttle 3 is fully forward, the pneumatic actuator 7 on the shuttle 3 detects this condition and opens the piloted valve 10. The compressed air behind pellet (a) forces it through the lower block 2 that contains a cylindrical vertical passageway 18 (also shown in FIG. 2) that is aligned with the vertical passageway 11 of block 1. The lower block 2 also contains four openings 2*a* (FIG. 2) located at the corners of the lower block 2 for the insertion of bolts 2*b*. Attached to the lower block 2 is the lower fitting 8 that the flexible hose (not shown) is attached to, acting as the gun barrel. The pellet exits a muzzle at the other end of the hose (not shown) and is propelled through the tube being cleaned. The shuttle 3 remains in the forward position and air continues to flow as long as the trigger is held down.

When the trigger is released the shuttle 3 moves rearward but before the hole 13 in it realigns with the vertical passageway 11, the projection on the release lever 4 jams the pellet (c) immediately above the one resting on the shuttle 3.

As the shuttle 3 continues to move to the rear position, the hole 13 comes into alignment, and a single pellet (b) falls into the lower portion of the lower block 2. The device 100 is now in the starting position again.

Figure 5:
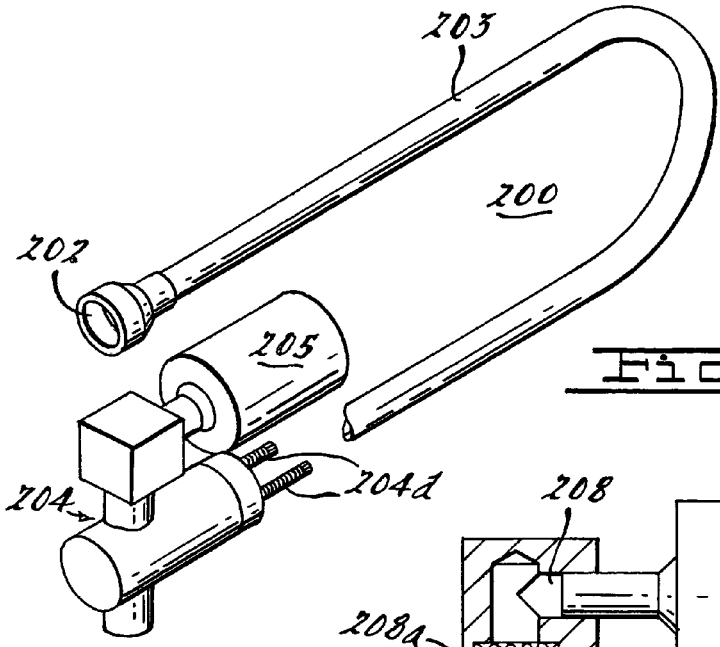
FIG. 5 shows a perspective view of an embodiment of a foam pellet catcher and retriever, according to the present invention.
Figure 6:
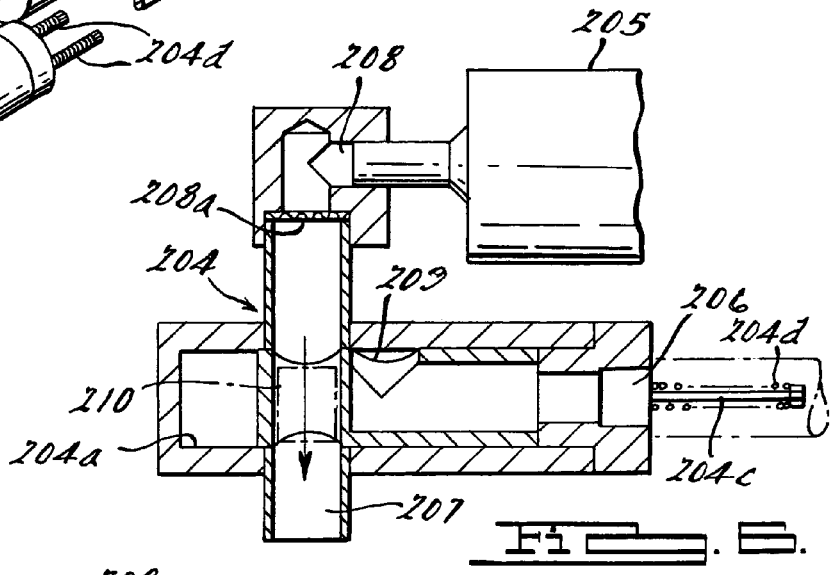
FIG. 6 shows a cut away of the receiver, according to one embodiment of the present invention.
Figure 7:
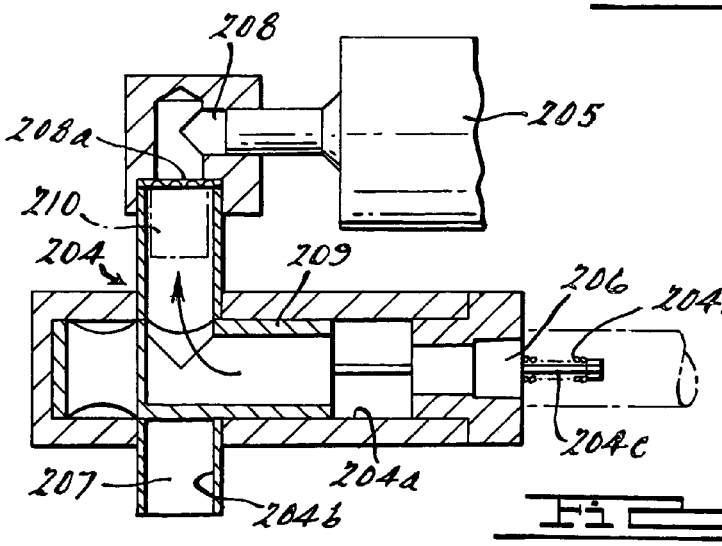
FIG. 7 shows a cross-sectional view of an embodiment of the retrieval chamber of FIG. 6.

FIGS. 5 and 6 show an embodiment of a foam pellet catcher and retriever ("FPCR") 200. The FPCR 200 includes a bell fitting 202, transfer tube 203, chamber 204 and a muffler 205. The chamber 204 includes an input opening 206 and an output opening 207, as shown in FIGS. 6 and 7. The chamber 204 is also known as a collection chamber. The muffler 205 is connected to the chamber 204 at opening 208. A screen 208*a* is disposed in the chamber 204 to prevent a pellet from exiting through opening 208.

Referring to FIGS. 6, 7 and 8, a slide valve 209 is positioned within the chamber 204. In operation, air pressure from the jet stream holds the slide valve 209 in position 1 (FIG. 7). As the jet stream continues, air escapes through an opening 203 in the slide valve 209 and out the muffler 205. The pellet is trapped in chamber 204 by way of the screen 208*a*. When the air pressure is released the valve is released and moves to position 2 (FIGS. 6 and 8), thus allowing the foam pellet 210 to fall through opening 207.

The collection chamber 204 is typically constructed of metal or plastic. In a preferred embodiment, the bell fitting 202 is a standard bell fitting and is connected to one end of the transfer tube 203. The transfer tube 203 may be bent into a large variety of complicated shapes and lengths and is typically made of copper or other bendable material that can withstand high air-pressure. Typically, the bell fitting 202 has a flexible seal opening to receive the exit end of a tube being cleaned and is connected to the transfer tube by clamps; however, other types of connections may be used provided they are non-obstructive. The other end of the transfer tube 203 is connected to the input opening 206 of the chamber 204 and is connected to the transfer tube 203 by clamps; however, other types of connections may be used provided they are non-obstructive. The muffler 205 is connected to opening 208 of the chamber 204. The muffler typically comprises a conventional pneumatic exhaust silencer. Such a silencer is commercially available from the Parker Division of Parker Hannifin Corp. However, other types of mufflers known in the art may be used. The muffler 205 may be connected to opening 208 by screwing the muffler 205 into threads in the opening 208, by soldering the muffler 205 to the opening 208, or by other attachment methods known in the art. The muffler 205 is used to control and reduce noise to acceptable levels for safety reasons because the present invention is used to clean tubes at a relatively high rate in close quartered work cells.

Referring to FIGS. 7, 7*a* and 8, the construction of an embodiment of the chamber 204 is further illustrated. The chamber 204 includes an end cap 204*a* having a coaxially disposed input opening 206 that receives an end of the transfer tube 203. The output opening 207 is formed in a portion of the chamber 204. Within an interior of the chamber 204 resides the slide valve 209 that is able to move freely slidably within a bore 204*a* of the chamber 204. An auxiliary port 204*b* is formed radially in line with the output opening 207. The auxiliary port 204*b* and output opening 207 each can communicate with an interior area of the slide valve 209 depending on the position of the slide valve 209.

An additional pair of holes 204*b*1 are located on opposite sides of the input opening 206 in the end cap 204*a*. Extending through each of the holes 204*b*1 is a rod 204*c*. Each rod 204*c* has a coil spring 204*d* disposed over a portion of its length, such that one end of each of the coil springs 204*d* abuts an outer surface of the end cap 204*a*. Opposite ends of each rod 204*c* are secured in blind openings in a surface 209*a* of the slide valve 209 such as by threaded engagement, adhesives or any other suitable coupling arrangements.

FIGS. 7 and 8 further illustrate the operation of the FPCR 200. As shown in FIG. 7, a spent pellet 210 enters the chamber 204 through the input opening 206. Typically, the spent pellet 210 is a foam pellet made of polyurethane. The spent pellet 210 emerges from a cleaned tube (not shown) and is propelled into the transfer tube 203 via the bell fitting 202 under air-pressure. The spent pellet 210 is then transferred from the transfer tube 203 into the chamber 204 through the input opening 206. In FIG. 7, the slide valve 209 moves to position 1 within the chamber 204 as long as there is air-pressure from the transfer tube 203. As shown in FIG. 7, when the air-pressure is removed, the slide valve 209 in the chamber 204 moves to position 2 due to the biasing force provided by the springs 204*d*. The spent pellet 210 then falls through the output opening 207 of the chamber 204. The spent pellet 210 may then be examined by an operator, at which time appropriate action can be taken.

FIGS. 9-11 show an embodiment of an attachment for fast loading foam pellets. This embodiment is comprised of a hopper made of a cylindrical container 300 about eight inches (20-32 mm) high with a removable cover (302) secured with buckles (not shown) to an outer wall 311. There are four air inlets 303 (only one being visible in FIGS. 9-11) around the periphery of a container floor 304 equally spaced close to an inside surface of the outer wall 311. These direct air upwardly and serve to circulate the foam pellets in an interior area 301 of the container 300. Mounted in the center of the container floor 304 is a cylinder piston device 305 having a piston 306. The device 305 passes through a central opening in the floor 304. A thin-walled vertical center tube 307 passes through the cylinder piston device 305 and extends into the interior area 301 of the container 300 to approximately two inches (5.08 mm) from the cover 302. An outer tube 308, slightly larger, is slipped over the tube 307 and is attached to the piston 306 (FIG. 10*a*). The outer tube 308 is free to slip over the center tube 307 and is cut at a 45 degree angle at the top (FIG. 10*b*). The tube lengths are such that when the outer tube (308) and its attached piston 306 are at the lower end of travel, the top of tube 308 is at or below the level of the top edge of tube 307 (FIG. 10*c*).

The cylinder piston device 305 in the floor 304 of the container 300 has several air ports. One set of ports 309 (only one being shown in FIGS. 10 and 11) carries air from the interior 301 of the container 300 to a space below the piston 306 within the cylinder piston device 305. The space above the piston 306 is vented to the outside via several radial ports 310 in the cylinder piston device 305.

In operation, typically three to four hundred foam pellets are placed in the container 300 and the cover 302 is attached. Air entering the interior area 301 from the ports 303 in the floor 304 flows out through the center tube 307. The air stream carries pellets into the center tube 307 where they pass down the tube 307 and stack up for loading into a pellet launcher. Below the container floor 304, the center tube 307 has ventilation ports 307*a* (FIGS. 10 and 11) in the tube 307 wall all along its length to allow the air to escape. Pellets will jam at the top opening if they are not oriented properly as they pass into the tube 307 (FIG. 10). When a jam occurs, the tube 307 is partially blocked, causing the pressure to rise in the interior area 301 of the container 300. This increase in pressure is communicated to the underside of the piston 306 through the set of ports 309. This causes the piston 306 to rise, lifting the outer tube 308 and righting the jammed pellet and allowing it to pass down into tube 307. Once air is flowing in the tube 307 again, air pressure in the ports 309 drops and the outer tube 308 falls to its resting position.

The cylinder piston device 305 device serves an additional role as a pressure relief valve. If pellets are not used fast enough by the launcher, they stack up in the tube 307. Although the tube 307 is vented, eventually the pellets will back up into the region of the tube that is inside the container 300. When this happens, the tube 307 is again blocked and the piston 306 raises past the set of ports 310 and the air escapes.

While various preferred embodiments have been described, those skilled in the art will recognize modifications or variations which might be made without departing from the inventive concept. The examples illustrate the invention and are not intended to limit it. Therefore, the description and claims should be interpreted liberally with only such limitation as is necessary in view of the pertinent prior art.

What is claimed is:

1. An apparatus for the retrieval and inspection of a spent pellet used in cleaning a tube comprising:

a transfer tube comprising a first end and a second end, said first end connected to said tube; and a chamber comprising an input opening, output opening and an exit opening, said input opening attached to said second end of said transfer tube, wherein when said spent pellet enters said first end of said transfer tube under air-pressure from said tube, said spent pellet is transferred to said chamber through said input opening of said chamber; and wherein said spent pellet exits said output opening of said chamber when said air-pressure is removed.

2. The apparatus of claim 1, wherein said transfer tube further comprises a flowing connected to said first end of said transfer tube and said tube.

3. The apparatus of claim 2, wherein said fitting comprises a bell fitting.

4. The apparatus of claim 1, wherein said chamber comprises a slide valve.

5. The apparatus of claim 4, wherein when said spent pellet enters into said chamber and said air pressure moves said slide valve to a first position trapping said pellet and allowing said air pressure to pass through said ext opening.

6. The apparatus of claim 1, wherein said chamber comprises a collection chamber.

7. The apparatus of claim 1, wherein said chamber further comprises a pass through muffler connected to said exit opening of said chamber.

8. The apparatus of claim 1, wherein said spent pellet comprises a foam pellet.

9. The apparatus of claim 1, wherein said spent pellet comprises a polyurethane foam pellet.

* * * * *